US007543869B2

(12) United States Patent
Davis et al.

(10) Patent No.: US 7,543,869 B2
(45) Date of Patent: Jun. 9, 2009

(54) ONE-HANDED SUPPORT FOR A PLATE AND A BEVERAGE CONTAINER

(75) Inventors: Theodore E. Davis, Tequesta, FL (US); Edwin A. Davis, Tequesta, FL (US); Jonathan T. Davis, Tequesta, FL (US)

(73) Assignee: Handitray, Inc., Tequesta, FL (US)

( * ) Notice: Subject to any disclaimer, the term of this patent is extended or adjusted under 35 U.S.C. 154(b) by 472 days.

(21) Appl. No.: 11/336,041

(22) Filed: Jan. 20, 2006

(65) Prior Publication Data

US 2007/0062939 A1 Mar. 22, 2007

Related U.S. Application Data

(63) Continuation-in-part of application No. 11/218,703, filed on Sep. 2, 2005.

(51) Int. Cl.
*B65D 1/36* (2006.01)
*A47G 23/06* (2006.01)

(52) U.S. Cl. ..... 294/146; 294/144; 206/563; 206/565

(58) Field of Classification Search ..... 294/137, 294/146, 172; 220/23.8, 23.83, 23.86, 556; 206/426, 557, 558, 561–565
See application file for complete search history.

(56) References Cited

U.S. PATENT DOCUMENTS

| | | | | | |
|---|---|---|---|---|---|
| 696,790 | A | * | 4/1902 | Atkinson | 206/541 |
| D130,770 | S | | 12/1941 | Morgan | |
| D159,454 | S | | 7/1950 | Waltman | |
| 2,828,047 | A | * | 3/1958 | Weiselberg | 206/189 |
| D185,911 | S | | 8/1959 | Chadbourne | |
| D195,527 | S | | 6/1963 | Gilbert | |
| D214,459 | S | | 6/1969 | Stageberg | |
| D221,035 | S | | 6/1971 | Raines | |
| D226,125 | S | | 1/1973 | Robinson | |
| 3,951,259 | A | * | 4/1976 | Oglesbee | 206/164 |
| 4,130,200 | A | * | 12/1978 | Iepson et al. | 206/705 |
| D265,154 | S | | 6/1982 | Cox | |
| 4,607,758 | A | * | 8/1986 | Stevens | 220/23.83 |
| D290,919 | S | | 7/1987 | Beute | |
| D293,767 | S | | 1/1988 | Powers | |
| 4,867,331 | A | | 9/1989 | Task | |
| 5,062,674 | A | * | 11/1991 | Magee | 294/143 |
| 5,234,125 | A | * | 8/1993 | Roberts | 220/574 |
| 5,607,077 | A | | 3/1997 | Torkelson | |
| 5,947,011 | A | | 9/1999 | Xu | |
| 5,950,856 | A | | 9/1999 | Cinque | |
| 6,702,141 | B1 | | 3/2004 | Cinque | |

* cited by examiner

*Primary Examiner*—Dean J Kramer
(74) *Attorney, Agent, or Firm*—McHale & Slavin, P.A.

(57) ABSTRACT

A one-handed support for a plate and a beverage container includes horizontally oriented parallel upper and lower supports having a vertical hand-grippable connecting member attached therebetween. The lower support is adapted to rest on a planar support surface. The upper and lower supports each having approximately circular front and rear sections with a narrow connecting portion therebetween with the connecting member being anchored in the narrow connecting portions. The upper support is sized to hold a disposable plate and includes a clip to hold the plate in place. The rear sections each have an aperture therein defining annular grips sized to receive a beverage container. The support includes a removable beverage container holder which is adapted to hold stemware in an inverted position. An alternative embodiment includes a rotatable stemware holder attached to the upper support and a rotatable auxiliary plate support.

24 Claims, 10 Drawing Sheets

ONE-HANDED SUPPORT FOR A PLATE AND A BEVERAGE CONTAINER

CROSS REFERENCE TO RELATED APPLICATIONS

This application is a continuation-in-part of application Ser. No. 11/218,703 filed Sep. 2, 2005, the contents of which are incorporated herein by reference.

FIELD OF THE INVENTION

The present invention relates to a combined plate and beverage container holder, and more particularly to a one-handed support for a plate and various size beverage containers.

BACKGROUND OF THE INVENTION

It often happens that refreshments are served at gatherings where table seating is not available for all guests, and the guests are required to awkwardly juggle a plate, a beverage, eating utensils and a napkin while standing. At a cocktail party, for example, the guest has to hold a beverage container in one hand and a plate with hors d'oeuvres in the other hand and rest the utensils on the edge of the plate. In order to eat from the plate, the guest must first find a place to temporarily set down the beverage.

Various trays and plates have been devised in the prior art which provide a means for holding a plate and a beverage, especially in situations such as cocktail parties where the guest often stands and moves about while eating and drinking. Task, U.S. Pat. No. 4,867,331, discloses a combination hors d'oeuvres, drink and utensil holder in the form of an oval-shaped plastic platform having various recessed compartments, with the beverage holder compartment depending downwardly from the platform and forming a handle for the user to grasp.

Torkelson, U.S. Pat. No. 5,607,077, discloses a hand-held support plate for serving foods and beverages comprising a rigid plate with various shallow recesses to hold food and drink. The plate includes a thumb aperture so that a thumb of a user can be inserted up through the aperture from the bottom of the plate to provide additional stability.

Xu, U.S. Pat. No. 5,947,011, discloses a plate formed from a rigid material having a shallow recess for food, a central thumb aperture, and a larger aperture sized to allow the passage of a cup partially therethrough. The user is able to place their thumb through the thumb aperture and use their fingers to grasp the cup in order to hold the plate in one hand.

Cinque, U.S. Pat. No. 5,950,856, discloses a combination plate and cup holder formed from a rigid plastic web having a recessed portion sized to receive and hold a plate and a circular beverage holding aperture having a sufficient diameter to hold a glass. The device also includes utensil and napkin holder aperture.

Representative design patents in the prior art include Morgan (U.S. Pat. No. D130,770), Waltman (U.S. Pat. No. D159,454), Chadbourne (U.S. Pat. No. D185,911), Gilbert (U.S. Pat. No. D195,527), Stageberg (U.S. Pat. No. D214,459), Raines (U.S. Pat. No. D221,035), Robinson (U.S. Pat. No. D226,125), Cox (U.S. Pat. No. D265,154), Powers (U.S. Pat. No. D293,767) and Beute (U.S. Pat. No. D290,919).

While many of these prior art devices may adequately serve their intended purpose, many drawbacks are evident in most of the prior art devices. Many of the devices do not provide adequate upper support for a beverage container sitting in the tray, making it likely the container may topple over when the tray is held in one hand. The prior art devices are most suitable for use with disposable beverage cups, and are not meant to be used with wine glasses or champagne flutes. It would therefore be highly desirable to provide a one-handed food and beverage support suitable for use at more formal gatherings which would securely accommodate glass stemware.

SUMMARY OF THE INVENTION

Accordingly, it is an objective of the present invention to provide a one-handed support for a plate and a beverage container which is suitable for use at parties and gatherings where limited table seating is available.

It is a further objective of the present invention to provide a one-handed support for a plate and a beverage container which includes a means to accommodate various size beverage containers, including stemware such as wine glasses and champagne flutes.

It is yet another objective of the present invention to provide a kit for assembling a one-handed support for a plate and a beverage container which can be disassembled for compact storage and quickly and easily assembled at the time of use.

It is a further objective of the present invention to provide a one-handed support for a plate and a beverage container which includes a beverage holder having a stabilizing member to prevent accidental spills.

It is yet another objective of the present invention to provide a one-handed support for a plate and a beverage container which is economical to manufacture.

In accordance with the above objectives, a first embodiment of a one-handed support for a disposable plate and a beverage container comprises horizontally oriented parallel upper and lower rigid supports having a vertical hand-grippable connecting member attached therebetween which can be ergonomically contoured to facilitate manual gripping. The lower support is adapted to rest on a planar support surface. The upper and lower supports each have approximately circular front and rear sections with a narrow connecting portion therebetween. The hand-grippable connecting member is anchored in the narrow connecting portions. The front circular sections are larger in diameter than the rear sections, with the front section being sized to hold a serving plate. The rear sections each have an aperture therein defining an annular grip sized to receive a beverage container which can include an opening therein to provide a C-shaped structure. The vertical connecting member has an upper end extending above the upper support, and a manually distendable tension clip is attached to the upper end of the connecting member positioned and configured to grasp the edge of a serving plate placed on the upper support.

The support includes a removable beverage container holder which has a cylindrical lower portion sized for closely aligned insertion into one of the apertures in the rear sections and an upper portion providing a supporting flange and an upwardly oriented concave surface contoured to receive the base of a beverage container therein. In use, the connecting member is available as a hand grip, and a plate can be placed on the front section of the upper support member and secured with the clip, and the beverage container holder can be inserted into annular grip in the lower support and a beverage placed therein and held upright with the annular grip in the upper support.

The beverage container holder has a slotted opening at an outer edge thereof sized to receive the stem portion of a stemmed drinking vessel. In an alternate mode of use the beverage container holder can be inverted and inserted into the annular grip of the upper support so that the slotted opening aligns with the opening in the annular grip, and a stemmed drinking vessel inserted into the slot and suspended therefrom.

In order to provide a support which can be readily assembled and dissassembled, the upper and lower supports each include a slotted opening extending longitudinally from the respective apertures in the upper and lower supports which are dimensioned to engage with the vertical hand-grippable connecting member. The connecting member includes upper and lower complementary lateral grooves dimensioned for tight engagement with the slots so the upper and lower supports can be press-fit onto the connecting member to form the one handed support. In an alternative embodiment, the connecting member is fixedly attached to the upper and lower supports.

In another alternative embodiment, a one-handed support for a disposable plate and a beverage comprises parallel horizontally oriented upper and lower rigid supports having a vertical hand-grippable connecting member therebetween configured for selective detachment therefrom, with the lower support having a lower surface adapted to rest on a planar support surface. The upper and lower supports each have approximately circular rear sections and a front section larger than the rear sections with a narrow connecting portion therebetween with the vertical connecting member being attachable to the narrow connecting portions. The front section of the upper support is approximately circular and sized to hold a serving plate, and the rear section of the upper support has an aperture therein defining an annular grip sized to receive a beverage container. The annular grip in the upper support can have an opening therein coincident with the longitudinal axis of the upper support. The rear section of the lower support includes a beverage container holder contoured to support the base of a beverage container which is coaxially aligned with the annular grip. The upper support has a plate anchoring structure extending vertically from the narrow connecting portion. A manually distendable tension clip is attached to the plate anchoring structure positioned and configured to grasp the edge of a serving plate placed on the upper support. The upper support further comprises a rotatable stemware holder constructed from a rigid material which is substantially flat and has an elongated shank portion with a horizontally oriented C-shaped distal end. The proximal end is rotatably mounted on the narrow connecting portion such that the stemware holder rotates in a plane parallel to the upper support and the stemware holder is positionable with respect to the annular grip. The stemware holder can be rotated into alignment with the longitudinal axis of the upper support so that the C-shaped distal end is aligned with the opening in the annular grip so that the stem portion of a stemmed drinking glass can be inserted into the annular grip through the opening and suspended in the C-shaped distal end of the stemware holder.

The support can also include an auxiliary rotatable plate support having a configuration approximately identical to the front section of the upper support. The rotatable plate support is rotatably mounted about the plate anchoring structure so as to be positionable between a position in which the rotatable plate support is in a coextensive arrangement with the front section and an offset position in which the support is at an approximate 45 degree angle to the front section.

The connecting member includes upper and lower mounting platforms positioned at upper and lower ends of the connecting member which are dimensioned for attachment to the narrow portions in the upper and lower supports. The platforms each have lateral edges configured for snap-in engagement with the narrow portions of the upper and lower supports. The narrow portions of the upper and lower supports include complementary notches sized for engagement with the lateral edges of the upper and lower mounting platforms.

Although the various embodiments have been illustrated with the upper and lower supports having approximately circular front and rear sections, it is within the purview of this instant invention to use other shapes, e.g. square, rectangular, or the like or to combine multiple shapes in a single embodiment as may be desired.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
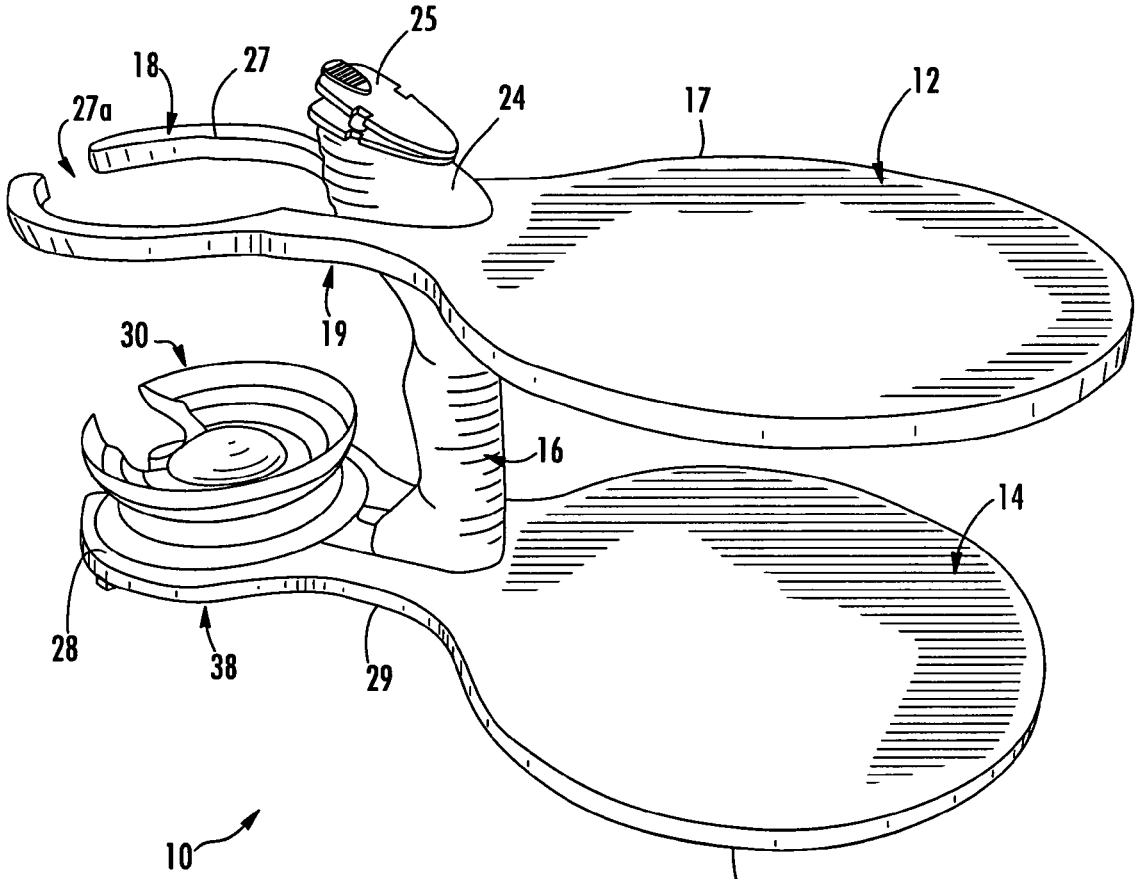
FIG. 1 is a perspective view of the one-handed plate and beverage support according to a first embodiment of the invention.
Figure 2:
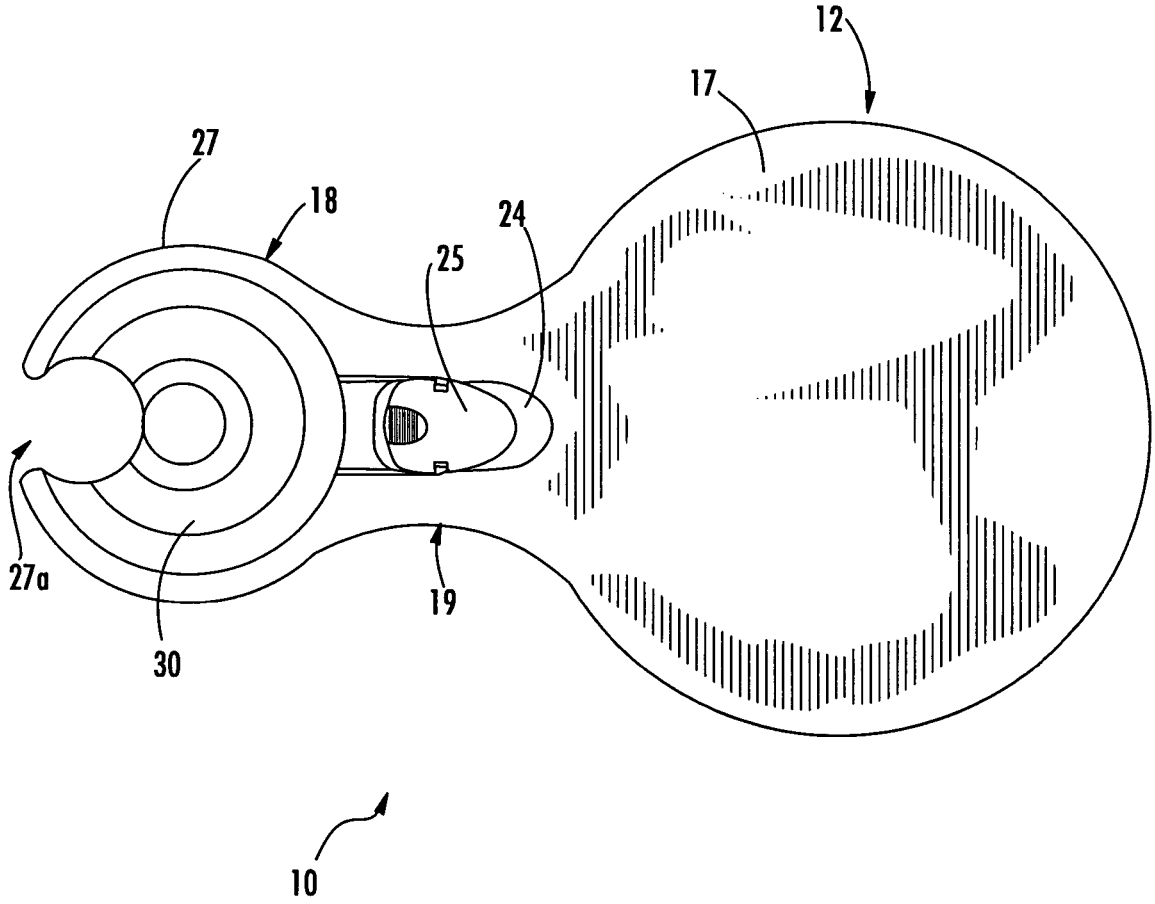
FIG. 2 is a top plan view of the support depicted in FIG. 1.
Figure 3:
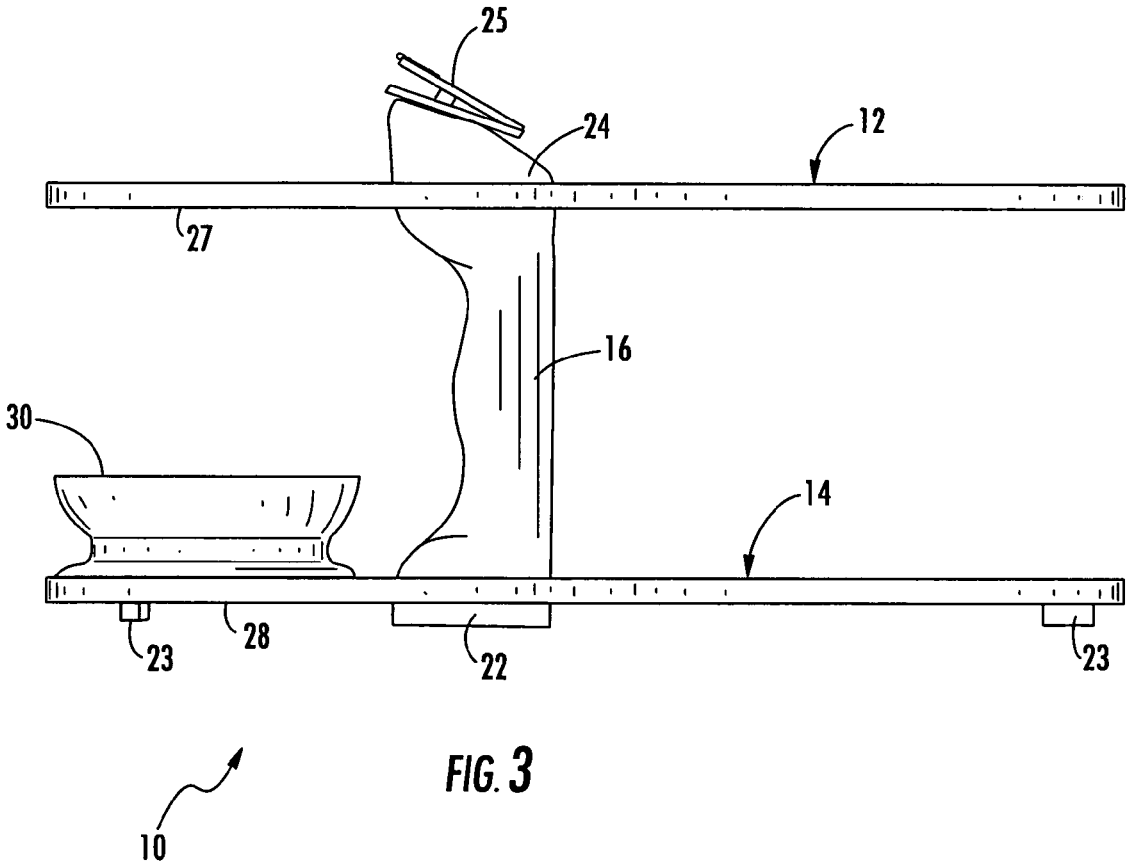
FIG. 3 is right side view of the support depicted in FIG. 1.

FIGS. 1-3 illustrate a one-handed support 10 for a disposable plate and a beverage according to a first embodiment of the invention. The support 10 includes horizontally oriented upper and lower rigid supports 12 and 14 which have a vertical hand-grippable connecting member 16 attached therebetween. The vertical connecting member 16 can be ergonomically contoured to facilitate manual grasping. The upper and lower supports 12 and 14 are supported parallel to one another with the lower support 14 having a lower surface adapted to rest on a planar support surface.

As illustrated, the upper support 12 has approximately circular front and rear sections 17 and 18 with a narrow connecting portion therebetween 19. The front section 17 is larger in diameter than the rear section 18 and is dimensioned to support a disposable plate or similar article. The lower support 14 similarly has approximately circular front and rear sections 27 and 38 with a narrow connecting portion 29 therebetween, and as can be seen in the exploded view shown in FIG. 4, the lower support 14 can have an identical configuration to the upper support 12 so that the respective parts are interchangeable at the time the article 10 is assembled.

The vertical hand-grippable connecting member 16 is anchored in the narrow connecting portions 19 and 29. When the support 10 is assembled as shown in FIGS. 1-3, the connecting member 16 has a lower end 22 extending slightly below the lower surface of the lower support 14 which cooperates with feet 23 (FIG. 3) to level the support 10 on a planar surface. The connecting member 16 has an upper end 24 extending above the upper support 12 which forms a plate anchoring structure. The upper end 24 includes a means for immobilizing the plate, illustrated as a manually distendable tension clip 25 mounted thereon which is positioned and configured to grasp the edge of a disposable plate placed on the upper support 12 to prevent the plate from sliding off.

The rear sections 17 and 18 each respectively have apertures concentric therein which define upper and lower annular grips 27 and 28. The annular grips 27 and 28 are sized to receive a typical single-serving beverage container, such as a plastic cup, can or bottle. The annular grips 27 and 28 can each include a gap or opening, indicated as 27*a* and 28*a*, which are preferably located along the longitudinal axis of the support 10.

The support 10 includes a detachable beverage container holder 30 which fits into the annular grips. As shown in the exploded view depicted in FIG. 4, the beverage container holder 30 has a cylindrical lower portion 31 sized for closely aligned insertion into one of the annular grips 27, 28. An upper portion 32 provides a supporting flange 33 which rests on the annular grip and an upwardly oriented concave surface 34 which is contoured to receive the base of a beverage container therein. In a first mode of use, the beverage container holder 30 is inserted into the lower annular grip 28 so that a beverage can be placed into the container holder 30 and held upright by the annular grip 28. The connecting member 16 is available to the user as a hand grip, and a plate can be placed on the front section 17 and secured with the clip 25.

Figure 5:
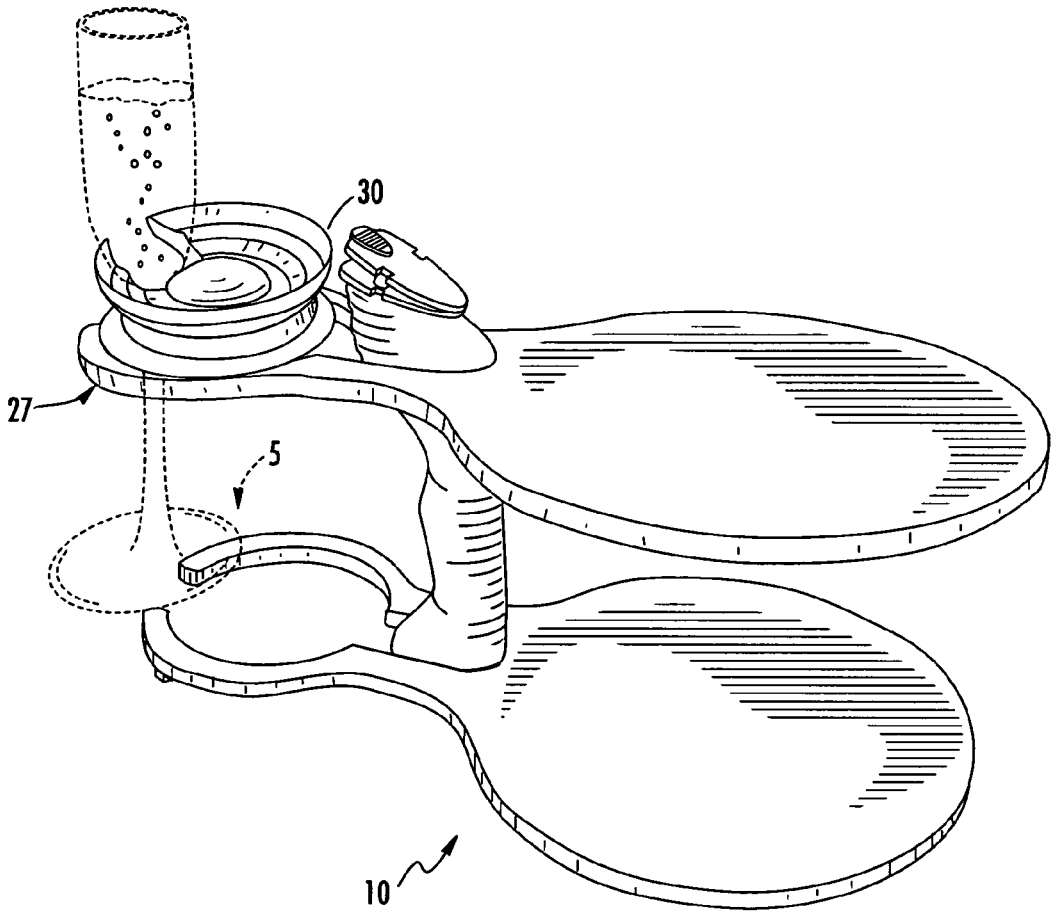
FIG. 5 illustrates a second mode of use for the support in FIG. 1 for support of a stemmed drinking vessel therein.

In a second mode of use, the support 10 can support stemware, such as a wine glass or a champagne flute. To support a stemmed glass, the beverage container holder 30 has a slotted opening 35 at an outer edge thereof sized to receive the stem portion of a stemmed drinking vessel. As shown in FIG. 5, the cylindrical lower portion 31 of the beverage container holder 30 is inserted into the annular grip 27 of the upper support 12 and the slotted opening 35 aligned with the opening 27*a* in the annular grip 27. A stemmed drinking glass 5 can then be inserted into the slotted opening 35 and suspended from the beverage container holder 30.

Figure 4:
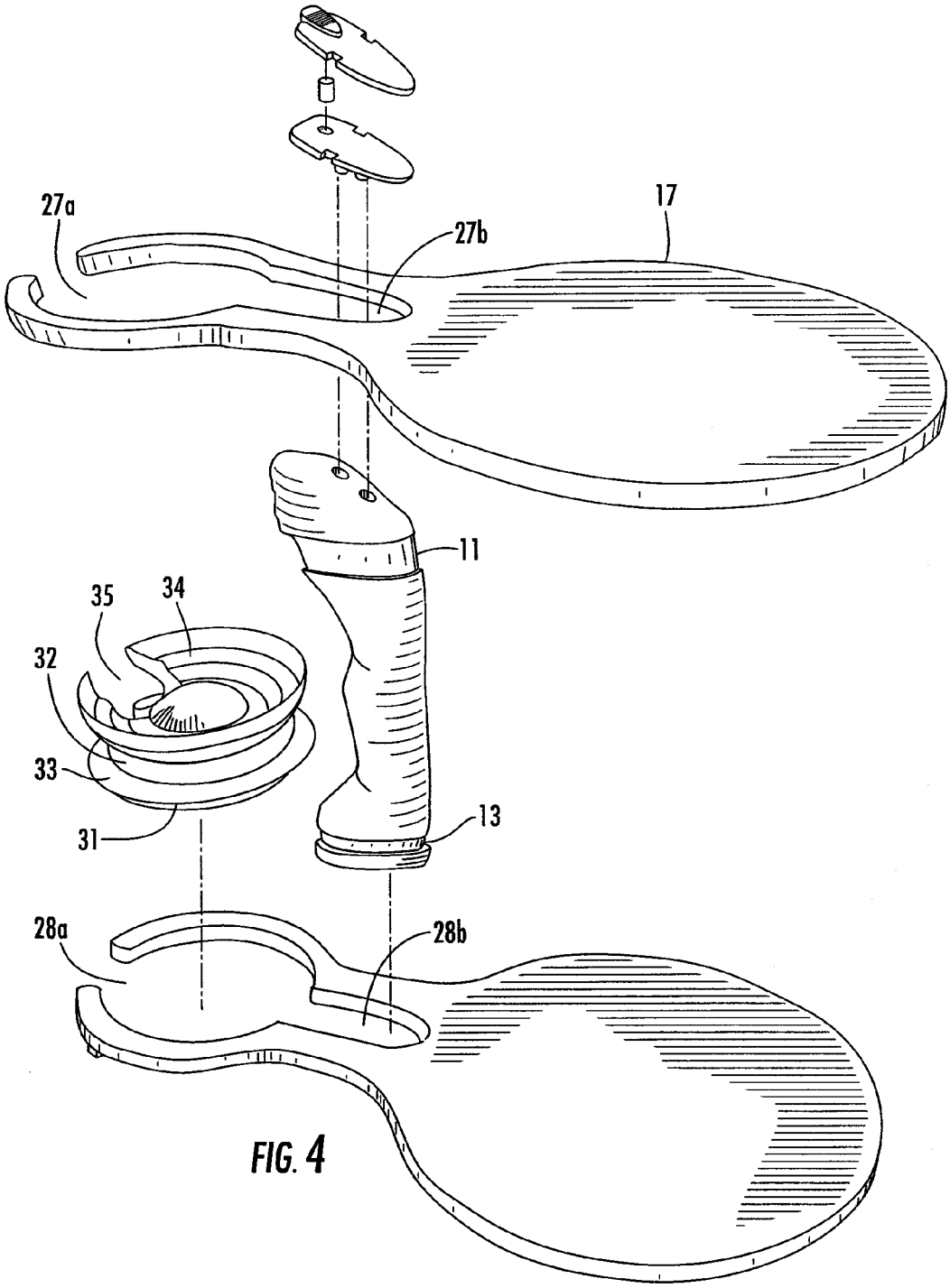
FIG. 4 is an exploded view showing the components of the support in FIG. 1 positioned for assemblage.

Referring again to the exploded view shown in FIG. 4, the upper and lower supports 12 and 14 each include a slotted opening 27*b* and 28*b* extending longitudinally from the respective apertures 27 and 28. The slotted openings 27*b* and 28*b* are dimensioned to engage with the complementary lateral grooves 11 and 13 in the connecting member 16. The lateral grooves 11 and 13 are dimensioned for tight engagement with the slots 27*b* and 28*b* so that the upper and lower supports 12 and 14 can be press-fit onto the connecting member to form the one handed support.

The upper and lower supports 12 and 14, the connecting member 16, and the beverage container 30 are constructed from an inexpensive rigid material, preferably plastic. However, other materials can be used depending on the desired end product, such as wood to create a "high end" article, or sturdy paper products for a disposable article.

Figure 6:
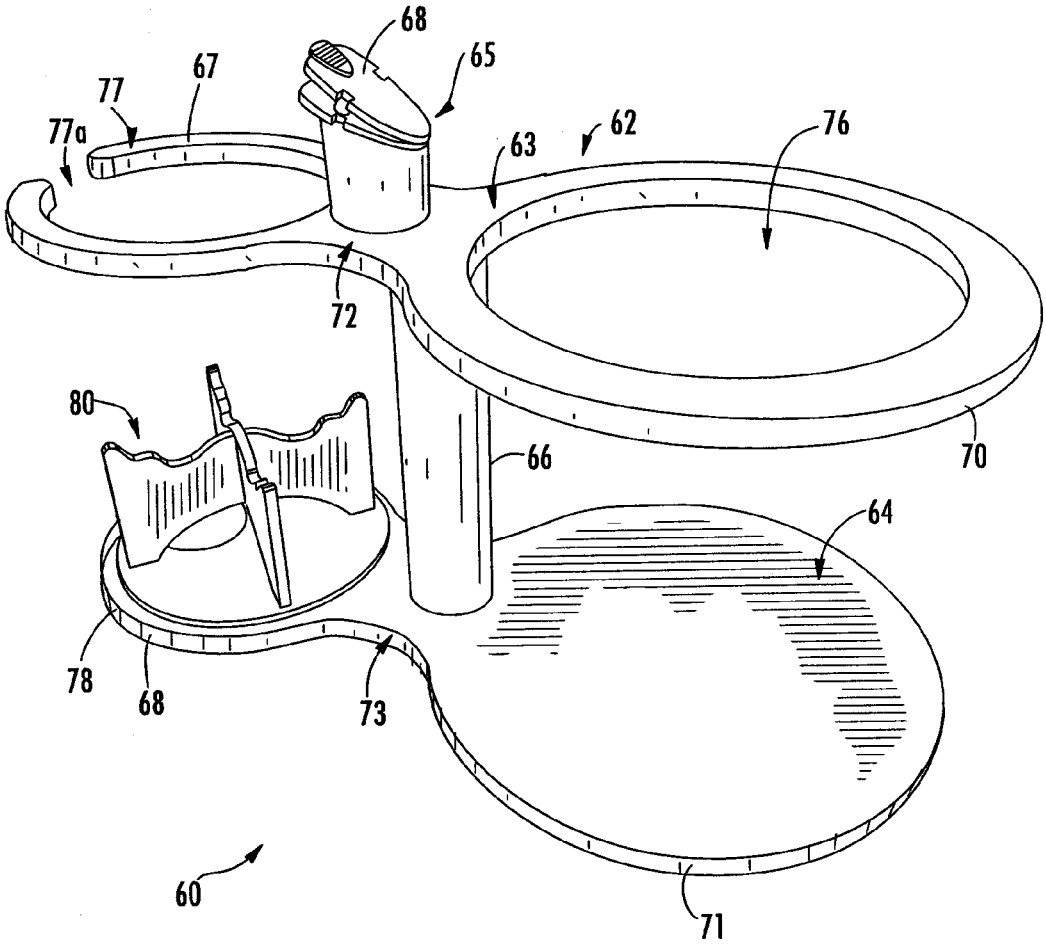
FIG. 6 is a perspective view of the one-handed plate and beverage support according to a second embodiment of the invention.

FIG. 6 illustrates an alternative embodiment 60 of the one-handed support of the invention. The support 60 includes horizontally oriented upper and lower rigid supports 62 and 64 which have a vertical hand-grippable connecting member 66 fixedly attached therebetween so that the supports are parallel to one another. The lower support 64 has a lower surface adapted to rest on a planar support surface. The upper and lower supports 62 and 64 each respectively include approximately circular rear sections 67 and 68 and front sections 70 and 71, with the front sections being larger than the rear sections. The upper and lower supports 62 and 64 each have narrow connecting portions 72 and 73 between their respective front and rear sections. The vertical hand-grippable connecting member 66 is attached to the narrow connecting portions 72 and 73. The front section 70 of the upper support 62 is approximately circular and sized to hold a serving plate or the like. The front section 71 of the lower support can also be approximately circular, and in the preferred embodiment has an outer perimeter identical to that of the upper support 62.

The front section 70 can be formed with an aperture 76 defining an annular support which can be used to hold a bowl or other container which can be inserted through the aperture 76. Smaller containers can be suspended in the aperture 76. Larger containers, e.g. a box of popcorn, can be supported by the front section 71 of the lower support 64 and held upright by the annular front section 70.

The upper surface 63 of the upper support 62 includes a plate anchoring structure 65 extending vertically from the narrow connecting portion 72. A manually distendable tension clip 68 is attached to the plate anchoring structure 65 which is positioned and configured to grasp the edge of a disposable plate placed on the upper support 62.

The rear sections 67 and 68 each respectively have apertures therein which define upper and lower annular grips 77 and 78 (FIG. 8) which are sized to receive beverage container therein. The annular grips 77 and 78 can each include a gap or opening, indicated as 77*a* and 78*a*, which are preferably located along the longitudinal axis of the support 60.

Figure 7A:
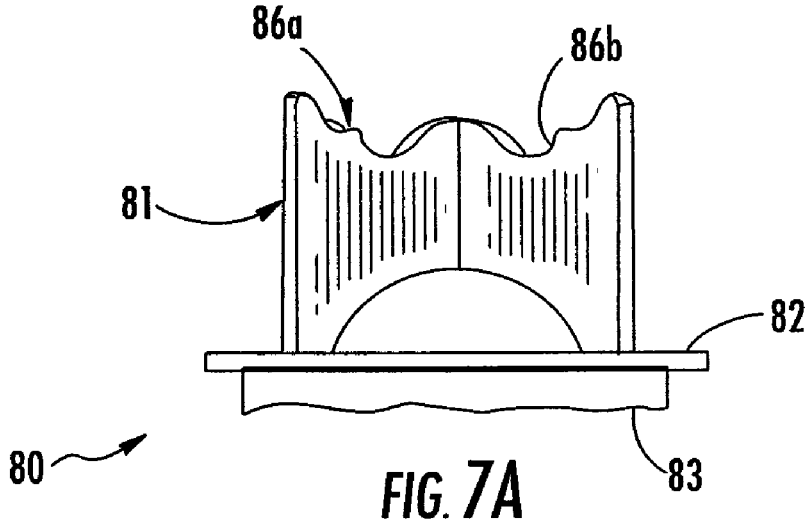
FIG. 7A is a side view of the beverage container holder shown detached from the support depicted in FIG. 6.
Figure 7B:
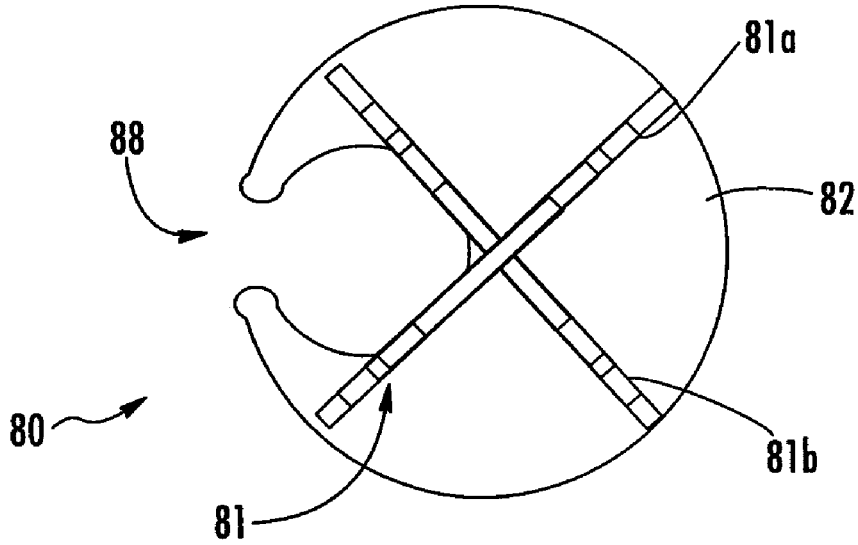
FIG. 7B is a top plan view of the beverage container holder shown in FIG. 7*a;*

The support 60 includes a removable beverage container holder 80 which is shown detached from the support 60 in FIGS. 7A and 7B. The beverage container holder has a base 82 having a cylindrical lower portion depending therefrom sized for closely aligned insertion into one of the annular grips 77, 78 with the base 82 providing a supporting flange. The container holder 80 includes an upwardly oriented structure 81 integral to the base which is contoured to receive a beverage container. In the preferred embodiment, the upwardly oriented structure 81 in the beverage container holder 80 includes two orthogonally intersecting diametrically oriented planar members 81*a* and 81*b* which have upper edges 86*a,b* which are contoured to conform to the diameter of a base of a beverage container. In use, the beverage container holder 80 can be inserted into annular grip 78 in the lower support 64 and a beverage placed therein and held upright with the annular grip 77 in the upper support 62.

Figure 8:
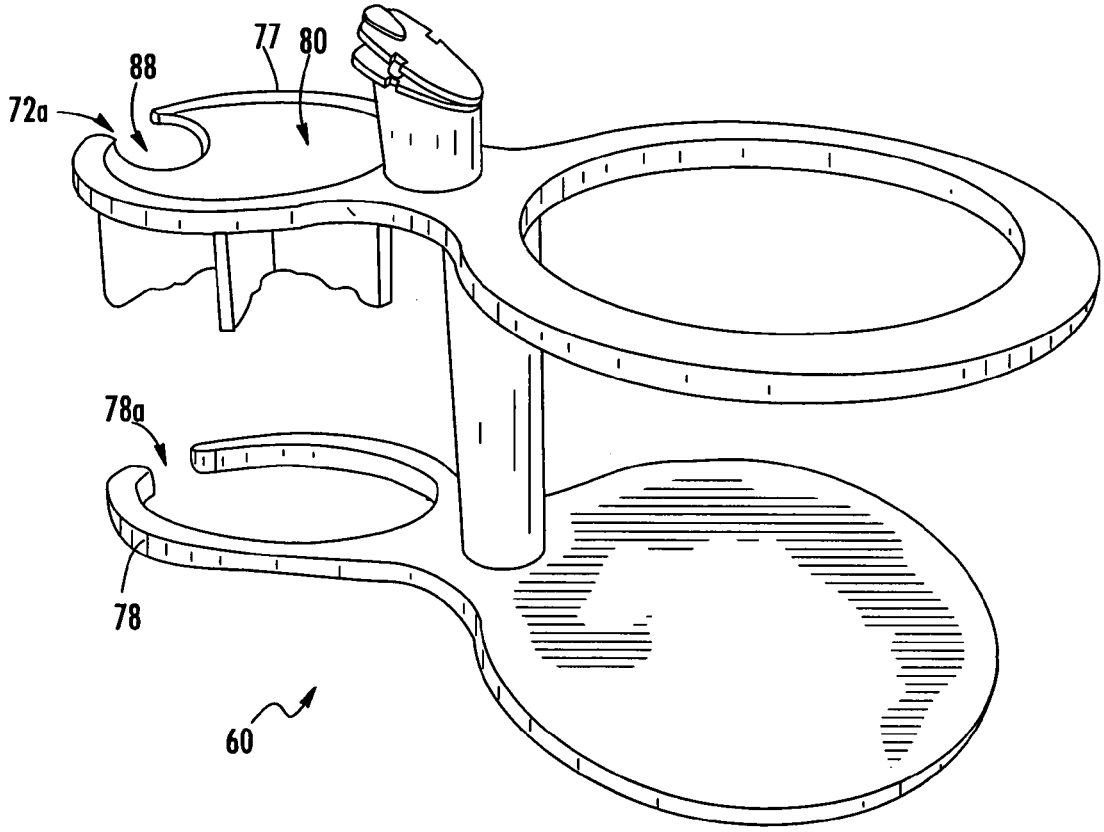
FIG. 8 illustrates a second mode of use for the support in FIG. 6 for support of a stemmed drinking vessel therein.

In the preferred embodiment, the beverage container holder 80 has an opening 88 at an edge thereof sized to receive the stem portion of a stemmed drinking vessel with the opening 88 positioned in a quadrant defined by the intersecting planar members 81*a,b*. As shown in FIG. 8, the beverage container holder 80 can be inserted into the annular grip 77 of the upper support 62 in an inverted position with the opening 88 aligned with the opening 77*a* in the annular grip. The stem portion of a stemmed drinking vessel 5 can then be inserted as shown in FIG. 8.

Figure 9:
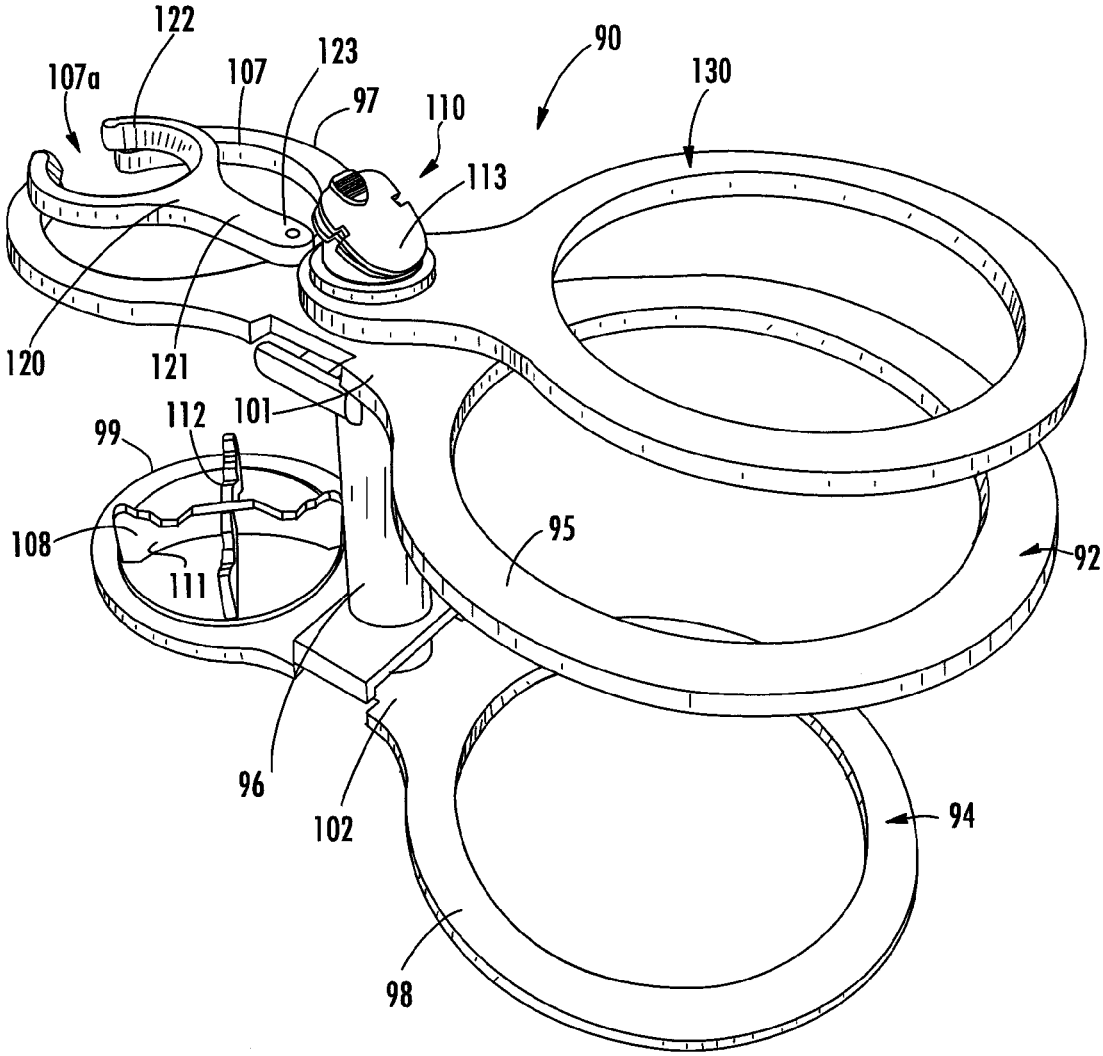
FIG. 9 is a perspective view of the one-handed plate and beverage support according to a third embodiment of the invention.
Figure 10:
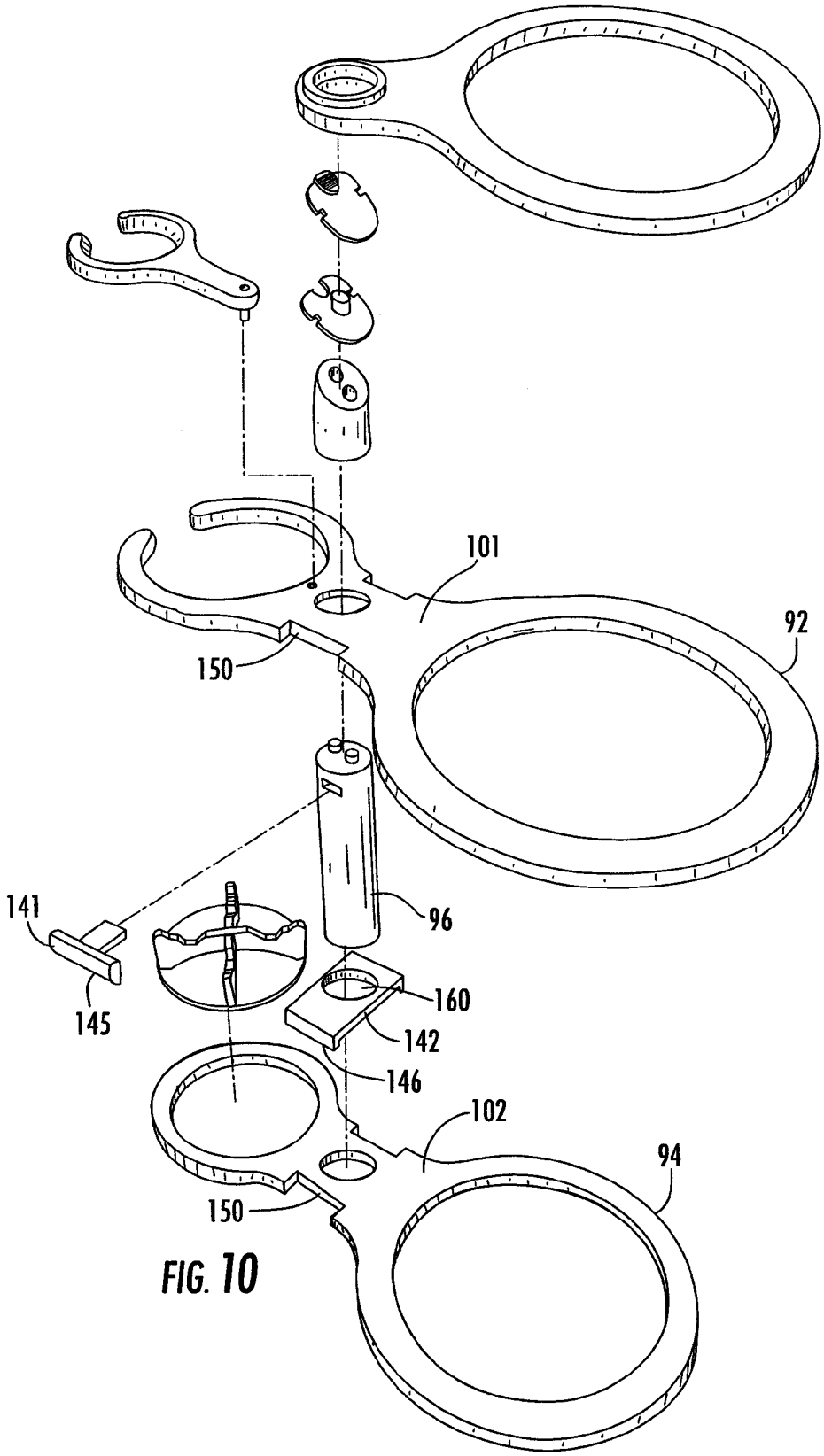
FIG. 10 is a perspective view of the support shown in FIG. 9 in a disassembled configuration.

Yet another embodiment 90 of the one-handed support of the invention is shown in FIG. 9. The support 90 includes horizontally oriented upper and lower rigid supports 92 and 94 which having a vertical hand-grippable connecting member 96 therebetween which supports the upper and lower supports 92 and 94 in a parallel arrangement with one another. The connecting member 96 can be detached from the upper and lower supports 92,94 for compact storage. The lower support 94 has a lower surface adapted to rest on a planar support surface. The connecting member 96 is configured for selective detachment from the supports 92 and 94, as shown in FIG. 10.

The upper support 92 has front and rear sections 95 and 97 which are approximately circular, with the front section 95 having a larger diameter than the rear section 97. The front section 95 is dimensioned to hold a disposable plate, and can include a concentric aperture defining an annular support for bowls and the like. The lower support 94 has a similar configuration, with front and rear sections 98 and 99 having dimensions identical to those of the upper support 92. Both the upper support 92 and the lower support 94 respectively include central narrow connecting portion 101, 102, with the connecting member 96 being attachable to the narrow connecting portions 101 and 102.

The rear section 97 of the upper support 92 has an aperture therein which defines an annular grip 107 which sized to receive a typical beverage container. The annular grip 107 has a gap or opening 107*a* therein which is preferably coincident with the longitudinal axis of the upper support 92. The rear section 99 of the lower support 94 includes a beverage container holder 108 which is contoured to support the base of a typical beverage container. The beverage container holder 108 is coaxially aligned with the annular grip 107 so that a beverage container can be inserted through the annular grip 107 and seated in the beverage container holder 108. In the preferred embodiment, the beverage container holder 108 includes two orthogonally intersecting diametrically oriented planar members 111 and 112 which have upper edges contoured to conform to the diameter of a base of a beverage container.

The support 92 includes a plate anchoring structure 110 extending from the narrow connecting portion 101. A manually distendable tension clip 113 is attached to the plate anchoring structure which is positioned and configured to grasp the edge of a serving plate placed on the upper support.

The support 90 includes a stemware holder 120 for securely holding stemmed glassware such as wine glasses and champagne flutes. The stemware holder 120 is flat and has an elongated shank portion 121 with a horizontally oriented C-shaped distal end 122. The stemware holder 120 has proximal end 123 which is rotatably mounted on the narrow connecting portion 101 of the upper support 92 so that the stemware holder rotates in a plane parallel to the upper support 92 and is positionable within the annular grip 107. When beverage containers are to be placed in the beverage container holder 108, the stemware holder 120 is rotated so that it does not obstruct the annular grip 107. To insert a stemmed drinking vessel into support 90, the stemware holder 120 is rotated until the opening defined by the C-shaped distal end 122 is aligned with the opening 107*a* in the annular grip 107. The stem portion of a stemmed drinking glass can be inserted into the annular grip 107 though the opening 107*a* and suspended in the C-shaped distal end 122 of the stemware holder 120.

The support 90 can further include a horizontally oriented rotatable auxiliary plate support 130 which has a configuration approximately identical to the front section 95 of the upper support 92. The rotatable plate support 130 is rotatably mounted about the plate anchoring structure 110 so as to be positionable between a position in which the rotatable plate support 130 is in a coextensive arrangement with the front section and an offset position at an approximate 45 degree angle to the front section 95. The rotatable plate support 130 provides an auxiliary plate support in addition to the front section 95. In order to support bowls and the like, the plate support 130 can also include a concentric aperture defining an annular support.

Any suitable attachment means can be used to connect the upper and lower supports 92 and 94 to the connecting member 96. As shown in FIG. 10, the connecting member 96 can include upper and lower mounting platforms 141, 142 which are positioned at upper and lower ends of the connecting member 96. The mounting platforms 141 and 142 are dimensioned for attachment to the narrow connecting portions 101 and 102. In the preferred embodiment, the platforms 141 and 142 each have lateral edges 145 and 146 which are configured for snap-in engagement with the narrow connecting portions 101 and 102. The narrow connecting portions 101 and 102 of the upper and lower supports 92 and 94 have side edges including notches 150 which are sized for engagement with the lateral edges 145 and 146 of the upper and lower mounting platforms 141 and 142. For added stability, the lower support 94 can include a central aperture 160 which receives a portion of the connecting member 96.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

We claim:

1. A one-handed support for a disposable plate and a beverage, comprising horizontally oriented upper and lower rigid supports having a vertical hand-grippable connecting member attached therebetween wherein said upper and lower supports are supported parallel to one another, said upper support having a front section sized to hold a plate thereon and a rear section having an aperture therein defining an annular grip sized to receive a beverage container, a fastening means adjacent said upper support operable to secure a plate on said upper support, a rear section of said lower support having an aperture defining an annular grip and adapted to hold a beverage container in coaxial alignment with said annular grip of said upper support, whereby said connecting member is available as a hand grip, and a plate can be placed on said front section of said upper support member, and a beverage container can be placed on said rear section of said lower support and a beverage container holder can be inserted into said annular grip in said lower support and a beverage placed therein and held upright with said annular grip in said upper support.

2. The one-handed support of claim 1, wherein said lower support has a front section providing a stabilizing member and a lower surface adapted to rest on a planar support surface.

3. The one-handed support of claim 2, wherein said upper and lower supports each have approximately circular front and rear sections with a narrow connecting portion therebetween with said vertical hand-grippable connecting member anchored in said narrow connecting portions.

4. The one-handed support of claim 3, wherein said front section of said upper support has a circular aperture defining an annular plate support.

5. The one-handed support of claim 1, wherein said aperture in said rear section of said lower support has a diameter equal to said aperture in said rear section of said upper support, and said lower support further comprises said beverage container holder having a cylindrical lower portion sized for closely aligned insertion into said aperture and an upper portion providing a supporting flange and an upwardly oriented structure adapted to support the base of a beverage container therein.

6. The one-handed support of claim 5, wherein said upwardly oriented structure is a bowl-shaped structure having a base contoured to support the base of a beverage container.

7. The one-handed support of claim 5, wherein said upwardly oriented structure in said beverage container holder comprises two orthogonally intersecting diametrically oriented planar members having upper edges contoured to conform to the diameter of a base of a beverage container.

8. The one-handed support of claim 5, wherein said annular grip of said upper support has an opening therein, and said beverage container holder has a slotted opening at an outer edge thereof sized to receive the stem portion of a stemmed drinking vessel, whereby said beverage container holder can be inserted into said annular grip of said upper support and said slotted opening aligned with the opening in said annular grip and a stemmed drinking vessel inserted therein.

9. The one-handed support of claim 5, wherein said apertures in said rear sections of said upper and lower supports each include a slotted opening extending longitudinally from said respective apertures in said upper and lower supports dimensioned to engage with said vertical hand-grippable connecting member, and said connecting member includes upper and lower complementary lateral grooves dimensioned for tight engagement with said slotted openings whereby said upper and lower supports are press-fit onto said connecting member to form said one handed support.

10. The one-handed support of claim 5, wherein said upper and lower supports are substantially identical.

11. The one-handed support of claim 10, wherein said upper and lower supports each have approximately circular front and rear sections with a narrow connecting portion therebetween wherein said vertical hand-grippable connecting member is attachable to narrow connecting portions.

12. The one-handed support of claim 11, wherein said front section of said upper support has a concentric circular aperture therein defining an annular support.

13. The one-handed support of claim 11, wherein said connecting member includes upper and lower mounting platforms positioned at upper and lower ends thereof, said mounting platforms dimensioned for attachment to said narrow connecting portions in said upper and lower supports, and said platforms each having lateral edges configured for snap-in engagement with said narrow portions.

14. The one-handed support of claim 11, wherein said narrow connecting portions of said upper and lower supports have side edges including notches therein sized for engagement with said lateral edges of said upper and lower mounting platforms.

15. The one-handed support of claim 1, wherein said connecting member extends above said upper support to provide a plate anchoring structure, and said fastening means comprises a manually distendable tension clip attached to said plate anchoring structure and positioned and configured to grasp the edge of a serving plate placed on the upper support.

16. The one-handed support of claim 1, wherein said vertical hand-grippable connecting member is ergonomically contoured to facilitate manual gripping.

17. The one-handed support of claim 1, wherein said upper and lower supports and said vertical connecting member are comprised of plastic.

18. A one-handed support for a disposable plate and a beverage, comprising;

horizontally oriented upper and lower rigid supports having a vertical handgrippable connecting member therebetween configured for selective detachment therefrom wherein said upper and lower supports are supported parallel to one another, said upper support having a front section sized to hold a serving plate on an upper surface thereof and a rear section having an aperture therein defining an annular grip sized to receive a beverage container, said annular grip having an opening therein coincident with the longitudinal axis of said upper support, said lower support having a rear section forming a beverage container holder contoured to support the base of a beverage container which is coaxially aligned with said annular grip, whereby said connecting member is available as a hand grip, and a plate can be placed on said front section of said upper support and a beverage can be inserted into said beverage container holder and held upright by said annular grip in said upper support, and a stemware holder, said stemware holder being substantially flat and having an elongated shank portion with a horizontally oriented C-shaped distal end and a proximal end rotatably mounted on said upper support such that said stemware holder rotates in a plane parallel to said upper support and is positionable within said annular grip whereby an opening defined by said C-shaped distal end can be rotated into alignment with said opening in said annular grip whereby the stem portion of a stemmed drinking glass can be inserted into said annular grip through said opening and suspended in said C-shaped distal end of said stemware holder.

19. The one-handed support of claim 18, wherein said lower support has a front section providing a stabilizing member and a lower surface adapted to rest on a planar support surface.

20. The one-handed support of claim 18, further comprising a fastening means adjacent said upper support operable to secure a plate on said upper support.

21. The one-handed support of claim 20, further comprising a plate anchoring structure extending upwardly from said upper support, and said fastening means comprises a a manually distendable tension clip attached to said plate anchoring structure and positioned and configured to grasp the edge of a serving plate placed on the upper support.

22. The one-handed support of claim 21, further comprising a horizontally oriented rotatable plate support having a configuration approximately identical to said front section of said upper support, said rotatable plate support being rotatably mounted about said plate anchoring structure so as to be positionable between a position in which said rotatable plate support is in a coextensive arrangement with said front section and an offset position at an approximate 45 degree angle to said front section whereby said rotatable plate support provides an auxiliary plate support in addition to said front section.

23. The one-handed support of claim 18, wherein said connecting member can be detached from said upper and lower supports for compact storage.

24. The one-handed support of claim 18, wherein said beverage container holder comprises two orthogonally intersecting diametrically oriented planar members having upper edges contoured to conform to the diameter of a base of a beverage container.

* * * * *